US012516582B1

(12) United States Patent
Al-Malki et al.

(10) Patent No.: US 12,516,582 B1
(45) Date of Patent: Jan. 6, 2026

(54) FREEING A DOWNHOLE SEAL IN A WELLBORE

(71) Applicant: Saudi Arabian Oil Company, Dhahran (SA)

(72) Inventors: Bandar Salem Al-Malki, Dammam (SA); Bader M. Alahmad, Dhahran (SA); Paolo Ilham Sola Gratia, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/763,640

(22) Filed: Jul. 3, 2024

(51) Int. Cl.
*E21B 34/10* (2006.01)
*E21B 31/00* (2006.01)

(52) U.S. Cl.
CPC ..... *E21B 31/002* (2013.01); *E21B 34/10* (2013.01)

(58) Field of Classification Search
CPC ..... E21B 31/005; E21B 31/107
See application file for complete search history.

(56) References Cited

U.S. PATENT DOCUMENTS 871,258 A * 11/1907 Criswell ..... E21B 31/107 166/178
4,463,814 A * 8/1984 Horstmeyer ..... E21B 4/04 166/212
7,762,330 B2 7/2010 Saylor, III et al.
9,353,589 B2 5/2016 Hekelaar
9,464,496 B2 10/2016 O'Rourke et al.
11,149,510 B1 10/2021 Al-Abdulrahman et al.
11,319,771 B2 5/2022 Al-Malki et al.
11,391,104 B2 7/2022 Al-Abdulrahman et al.
11,414,985 B2 8/2022 Gooneratne et al.
11,585,177 B2 2/2023 Al-Mousa et al.
11,828,128 B2 11/2023 Al-Mousa et al.
2012/0292909 A1* 11/2012 Eriksen ..... E21B 34/025 290/52
2020/0325746 A1* 10/2020 Lerbrekk ..... E21B 33/13
2022/0341273 A1* 10/2022 Al-Mousa ..... E21B 31/107

* cited by examiner

*Primary Examiner* — Cathleen R Hutchins
(74) *Attorney, Agent, or Firm* — Fish & Richardson P.C.

(57) ABSTRACT

A downhole tool includes a top sub-assembly configured to couple to a downhole conveyance that is operable to run the downhole tool into a wellbore formed from a terranean surface into a subterranean formation; a piston sub-assembly coupled with the top sub-assembly and including a plurality of pistons configured to moveably contact a portion of a seal assembly installed in the wellbore to generate mechanical vibrations to jar the seal assembly from being stuck in the wellbore; a cutting sub-assembly coupled with the top sub-assembly and the piston sub-assembly and including at least one cutting blade configured to moveably cut through a portion of a production tubing adjacent the seal assembly; and a motor assembly coupled with the piston sub-assembly and the cutting sub-assembly, the motor assembly including a motor configured to supply power to the piston sub-assembly and the cutting sub-assembly.

21 Claims, 6 Drawing Sheets

FREEING A DOWNHOLE SEAL IN A WELLBORE

TECHNICAL FIELD

The present disclosure describes apparatus, systems, and methods for freeing a downhole tool, such as a wellbore seal, which is stuck in a wellbore.

BACKGROUND

A conventional process to release stuck objects in a wellbore, such as a stuck seal assembly, is to deploy a down hole cutter to cut above the stuck object, then run an overshot with fishing assembly back into the wellbore with a jar to free the stuck object. If a fishing operation is not successful, then a milling operation is carried out to mill and retrieve the object. An average time for a conventional object-freeing procedure takes around eleven days of rig time, which has an impact of well cost and can delay the delivery time to complete a workover scope due to this operational difficulty.

SUMMARY

In an example implementation, a downhole tool includes a top sub-assembly configured to couple to a downhole conveyance that is operable to run the downhole tool into a wellbore formed from a terranean surface into a subterranean formation; a piston sub-assembly coupled with the top sub-assembly and including a plurality of pistons configured to moveably contact a portion of a seal assembly installed in the wellbore to generate mechanical vibrations to jar the seal assembly from being stuck in the wellbore; a cutting sub-assembly coupled with the top sub-assembly and the piston sub-assembly and including at least one cutting blade configured to moveably cut through a portion of a production tubing adjacent the seal assembly; and a motor assembly coupled with the piston sub-assembly and the cutting sub-assembly, the motor assembly including a motor configured to supply power to the piston sub-assembly and the cutting sub-assembly.

In an aspect combinable with the example implementation, the downhole conveyance includes a wireline, and the motor includes an electric motor configured to operate with electrical power supplied through the wireline to operate the piston sub-assembly and provide electrical power to the cutting sub-assembly.

In another aspect combinable with one, some, or all of the previous aspects, the plurality of pistons are configured to moveably contact the portion of the seal assembly at an angle offset from an axial direction of the wellbore.

In another aspect combinable with one, some, or all of the previous aspects, the seal assembly is installed in a production packer, and the plurality of pistons are configured to moveably contact the portion of the seal assembly installed in the production packer to generate the mechanical vibrations to jar the seal assembly from being stuck in the production packer.

In another aspect combinable with one, some, or all of the previous aspects, the portion of the seal assembly includes an interior radial surface of the seal assembly.

In another aspect combinable with one, some, or all of the previous aspects, the downhole conveyance includes a tubular working string, and the motor includes a hydraulic motor configured to operate with a flow of a wellbore fluid supplied through the tubular working string to operate the piston sub-assembly and generate electrical power to the cutting sub-assembly.

In another aspect combinable with one, some, or all of the previous aspects, the tubular working string includes a multicycle valve installed uphole of the top sub-assembly, the multicycle valve configured to operate the hydraulic motor in a plurality of operating modes based on one or more characteristics of the flow of the wellbore fluid.

In another aspect combinable with one, some, or all of the previous aspects, the one or more characteristics of the flow of the wellbore fluid includes at least one of a flow rate or a pressure of the flow of the wellbore fluid.

In another aspect combinable with one, some, or all of the previous aspects, in a first operating mode, the hydraulic motor is configured to operate the piston sub-assembly with the flow of the wellbore fluid.

In another aspect combinable with one, some, or all of the previous aspects, in a second operating mode, the hydraulic motor is configured to generate electrical power to the cutting sub-assembly with the flow of the wellbore fluid.

In another example implementation, a method for freeing a stuck seal assembly in a wellbore includes running a downhole tool on a downhole conveyance through a wellbore formed from a terranean surface into a subterranean formation. The downhole tool includes a piston sub-assembly coupled with the top sub-assembly and including a plurality of pistons; a cutting sub-assembly coupled with the top sub-assembly and the piston sub-assembly and including at least one cutting blade; and a motor assembly coupled with the piston sub-assembly and the cutting sub-assembly, the motor assembly including a motor. The method includes operating the motor to supply power to the piston sub-assembly to move the plurality of pistons to contact a portion of a seal assembly installed in the wellbore to generate mechanical vibrations to jar the seal assembly from being stuck in the wellbore; and operating the motor to supply electrical power to the cutting sub-assembly to rotate the at least one cutting blade to cut through a portion of a production tubing adjacent the seal assembly.

In an aspect combinable with the example implementation, the downhole conveyance includes a wireline, and the motor includes an electric motor, and the method includes operating the electric motor with electrical power supplied through the wireline to operate the piston sub-assembly; and providing electrical power from the electric motor to the cutting sub-assembly.

Another aspect combinable with one, some, or all of the previous aspects includes operating the plurality of pistons to moveably contact the portion of the seal assembly at an angle offset from an axial direction of the wellbore.

In another aspect combinable with one, some, or all of the previous aspects, the seal assembly is installed in a production packer, and the method includes operating the plurality of pistons to moveably contact the portion of the seal assembly installed in the production packer to generate the mechanical vibrations to jar the seal assembly from being stuck in the production packer.

In another aspect combinable with one, some, or all of the previous aspects, the portion of the seal assembly includes an interior radial surface of the seal assembly.

In another aspect combinable with one, some, or all of the previous aspects, the downhole conveyance includes a tubular working string, and the motor includes a hydraulic motor, and the method includes operating the hydraulic motor with a flow of a wellbore fluid supplied through the tubular working string to operate the piston sub-assembly; and generating electrical power to the cutting sub-assembly with the hydraulic motor.

In another aspect combinable with one, some, or all of the previous aspects, the tubular working string includes a multicycle valve installed uphole of the top sub-assembly, and the method includes circulating the wellbore fluid at one or more characteristics through the multicycle valve to operate the hydraulic motor in a plurality of operating modes.

In another aspect combinable with one, some, or all of the previous aspects, the one or more characteristics of the flow of the wellbore fluid includes at least one of a flow rate or a pressure of the flow of the wellbore fluid.

Another aspect combinable with one, some, or all of the previous aspects includes, in a first operating mode, operating the hydraulic motor to operate the piston sub-assembly with the flow of the wellbore fluid.

Another aspect combinable with one, some, or all of the previous aspects includes, in a second operating mode, operating the hydraulic motor to generate electrical power to the cutting sub-assembly with the flow of the wellbore fluid.

Implementations of a downhole tool for freeing a stuck seal assembly from a wellbore according to the present disclosure may include one or more of the following features. For example, implementations according to the present disclosure can free a stuck seal assembly in a wellbore through mechanical vibrations and hammering in a single trip. As another example, implementations according to the present disclosure can cut a production tubing from a stuck seal assembly in the same trip as operations to free the stuck seal assembly.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes example implementations of a downhole tool that can be run into a wellbore and operated to release a wellbore component, such as a seal assembly installed in the wellbore, which is stuck. In some aspects, the downhole tool can be operated to perform lateral and axial vibrations at different frequency rate across a seal assembly area to facilitate freeing of the seal assembly in the wellbore. In some aspects, such mechanical actions can create a seal movement to release the seal assembly that, for instance, is stuck in a completion packer profile. Example aspects according to the present disclosure can also include a tubular cutting assembly, such that, if a need arises to cut the seal assembly from installation in the wellbore (such as, installed in production casing), the downhole tool can perform the cutting without an additional run out of and run into the wellbore.

Figure 1:
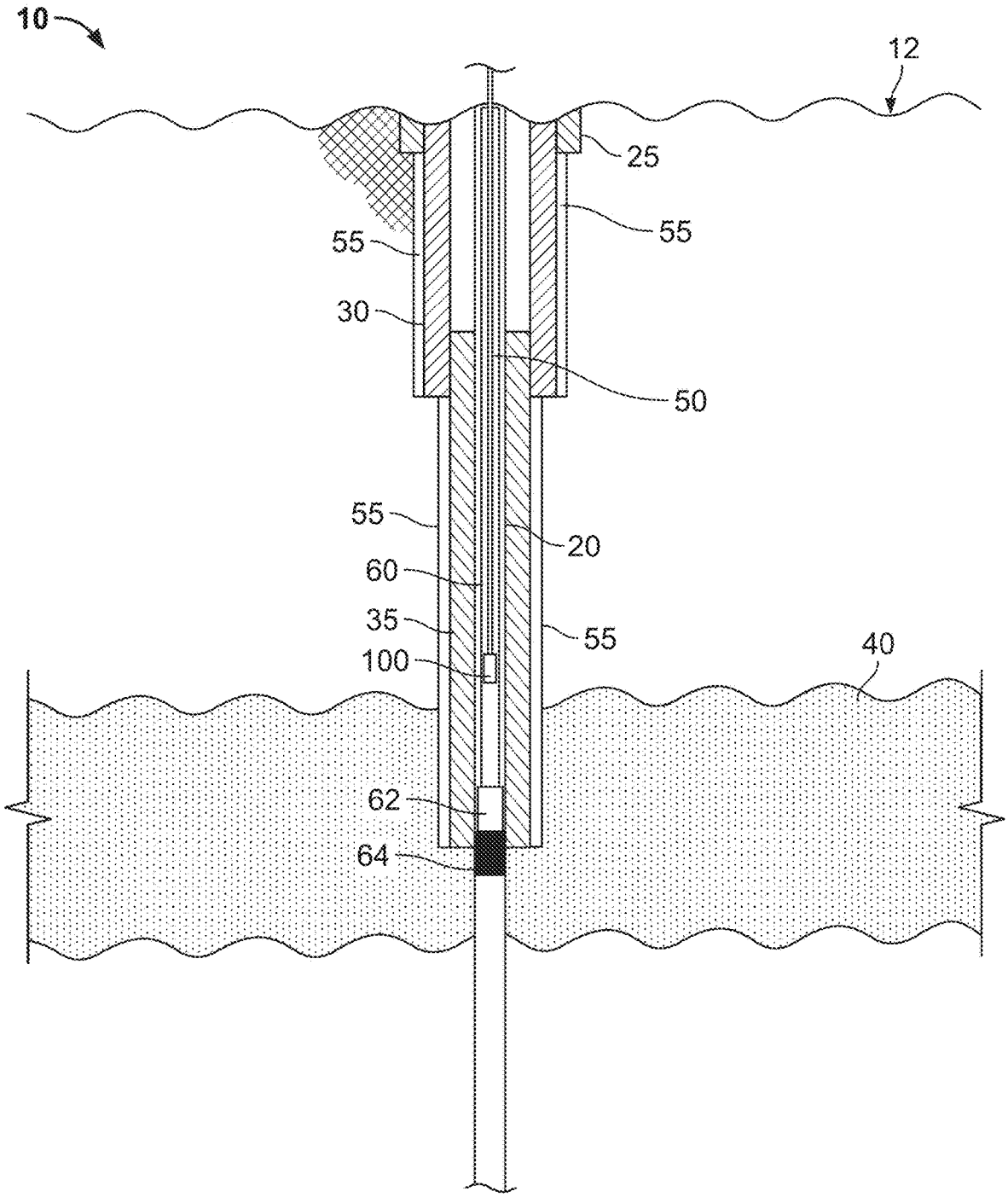
FIG. 1 is a schematic diagram of a downhole tool for freeing a seal assembly that is stuck in a wellbore according to the present disclosure.

FIG. 1 is a schematic diagram of wellbore system 10 that includes a downhole tool 100 according to the present disclosure. Generally, FIG. 1 illustrates a portion of one embodiment of a wellbore system 10 according to the present disclosure in which the downhole tool 100 may be run into a wellbore 20 and activated at a particular location within the wellbore 20 to, for example, free a stuck wellbore component, such as a seal assembly 62 that is installed at a production packer 64 in the wellbore 20.

In this example, the downhole tool 100 is coupled to a downhole conveyance 50, such as a wireline, or other conveyance that, in some aspects, may facilitate the transmission of electrical power to the downhole tool 100 while in the wellbore 20. Generally, and as described in more detail herein, the downhole tool 100 can be operated to generate and transmit mechanical vibrations to the seal assembly 62 in order to free it from being stuck in the production packer 64. In some aspects, the downhole tool 100 can be further operated to cut a wellbore tubular (such as production tubing 60) at a desired location uphole of the seal assembly 62.

As shown, the wellbore system 10 accesses a subterranean formation 40 that provides access to hydrocarbons located in such subterranean formation 40. A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as an intermediate casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 can be the intermediate casing 30. The intermediate casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Other casings, not specifically shown in this figure, can be included within the wellbore system 10 without departing from the scope of this disclosure. Further, other tubulars (such as liners or otherwise), along with casings, can generally be referred to as "wellbore tubulars" in the present disclosure.

As shown in FIG. 1, a cement layer 55 (or cement 55) is installed in an annulus between each illustrated casing (conductor casing 25, intermediate casing 30, and production casing 35) and the adjacent geologic formation (such as subterranean formation 40). Cement 55 can be circulated downward, during the construction of the wellbore system 10, through one or more casings and back upward into the annulus between the particular casing and the adjacent geologic formation in order to, for example, bond the casing to the formation. Once solidified in the annulus, the cement 55 can provide a barrier to fluid entry into the wellbore 20 as well as maintain the casings in place.

Figure 2:
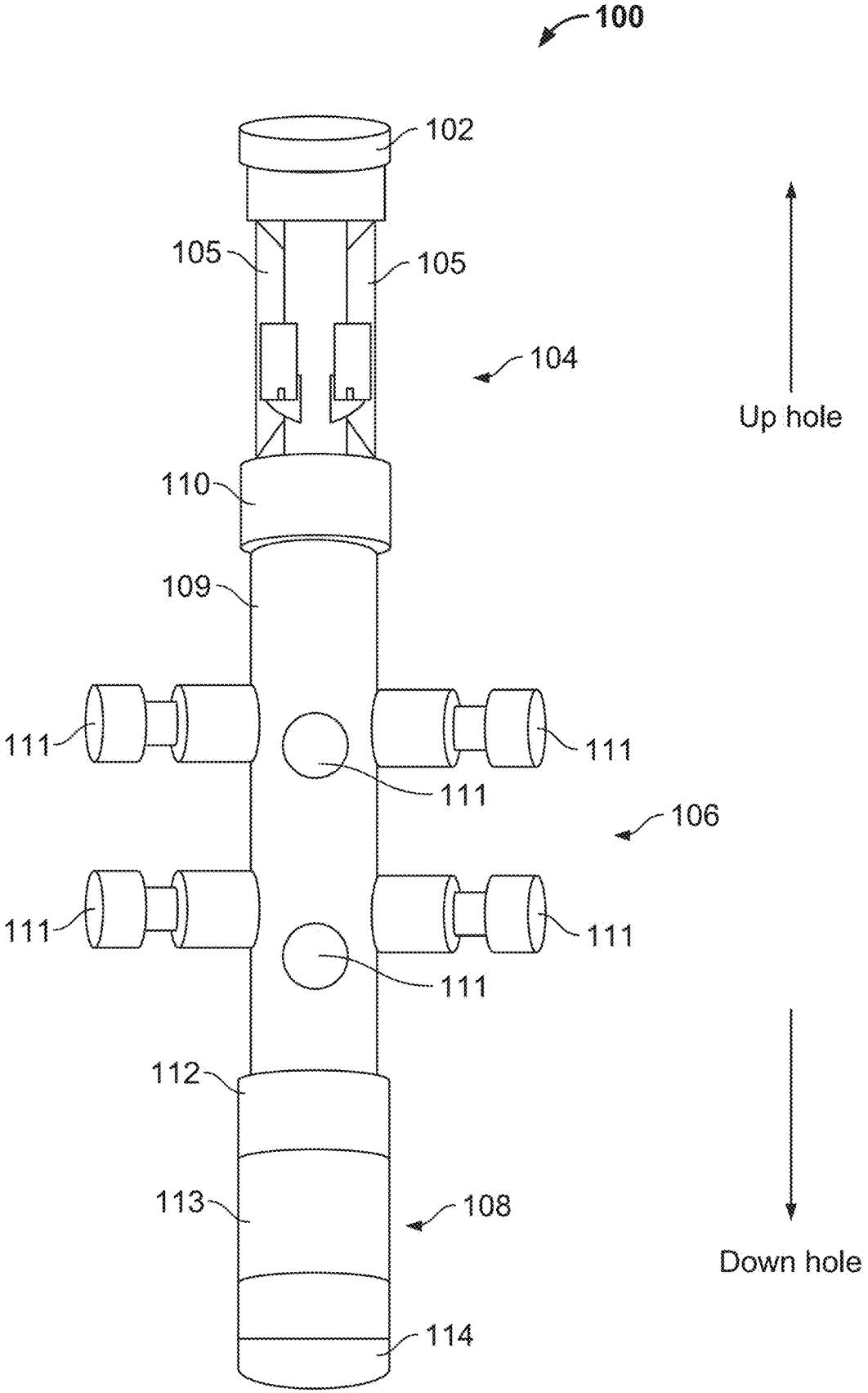
FIGS. 2 and 3 are schematic diagrams of an example implementation of the downhole tool of FIG. 1 according to the present disclosure.

FIG. 2 is a schematic diagram of an example implementation of the downhole tool 100, such as in a run-into-hole (RIH) position. As shown in FIG. 2, the downhole tool 100 is comprised of multiple sub-assemblies that are coupled together to form the tool 100, which, in this example, includes a bore 201 that extends through at least a portion of a length of the downhole tool 100 and through one or more of the sub-assemblies (such as, for fluid circulation there through).

In this example implementation, the downhole tool 100 includes a top sub-assembly 101 that is configured to attach to or couple with the downhole conveyance 50 shown in FIG. 1 (for example, a wireline, tubing string, or otherwise). In some aspects, the top sub-assembly 102 includes a power connection to the downhole conveyance 50, which facilitates electrical power from the downhole conveyance 50 to the downhole tool 100 (such as, to activate one or more of the sub-assemblies of the downhole tool 100 as described herein).

This example implementation of the downhole tool 100 also includes a cutting sub-assembly 104 that is coupled with the top sub-assembly 102. As shown, the cutting sub-assembly 104 includes one or more cutting blades 105 that are extendable from the downhole tool 100 and configured to cut or break through a wellbore tubular, such as a casing or production tubing 60. In some aspects, the cutting sub-assembly 104 comprises a hydraulic or mechanical casing-cutting tool, which, after run to a desired cutting depth, can be activated electrically with electrical power provided by the downhole conveyance 50 or hydraulically (for example, by pressure of a fluid circulated through the downhole conveyance 50) or mechanically (for example, by rotating or slacking the downhole tool 100, or both).

This example implementation of the downhole tool 100 also includes a piston sub-assembly 106 that is coupled with the cutting sub-assembly 104 through a connector 110. In this example, the piston sub-assembly 106 includes multiple piston assemblies (also called pistons) 111 that extend from a housing 109 of the cutting sub-assembly 106. The piston assemblies 111 of the downhole tool 100 are arranged, in this example, in generally linear arrays along the housing 109 of the piston sub-assembly 106. Generally, the piston sub-assembly 106 operates to provide mechanical vibrations to the seal assembly 62 installed in the wellbore tubular (such as production tubing 60) through a hammering effect. In some aspects, the piston sub-assembly 106 operates to break apart (such as, fracture) any bonds that cause the seal assembly 62 to be stuck in the production packer 64. The piston assemblies 111 can be operated (for example, by the motor assembly 108) in an oscillating fashion and interchangeably to deliver instantaneous hammering forces to the stuck seal assembly 62. In some aspects, the hammering forces can be at least 3,000 pounds per square inch (psi) against an internal radial surface of the seal assembly 62 in order to jar the seal assembly 62 loose from the production packer 64. In some aspects, the piston sub-assembly 106 is rotatable about a longitudinal axis of the downhole tool 100 during operation of the piston assemblies 111 (such as through rotation of the housing 109 relative to the connector 110).

The illustrated implementation also includes the motor assembly 108 coupled to the piston sub-assembly 106 through a connector 112. The motor assembly 108, in this example, includes electric motor 113 that can receive electric power from the downhole conveyance 50 and operate the piston assemblies 111 to extend from the housing 109 and, in some aspects, rotate in a radial direction on the housing 109. In the case of a hydraulically operated downhole tool 100, the motor assembly 108 can include a hydraulic motor 113 that uses a flow of fluid through the downhole tool 100 to operate the piston assemblies 111.

For instance, in the case of a hydraulic motor 113, a multicycle valve tool can be installed in the production tubing 60 uphole of the seal assembly 62 (which will allow the downhole conveyance 50 to be coiled tubing or drill pipe as well). A multicycle valve tool (shown schematically as multicycle valve tool 450 in FIG. 4B) can be designed with a pressure and rate activation related to a working fluid that is circulated through the downhole conveyance. In some aspects, the multicycle valve tool can operate in multiple modes. An example mode can be regular circulation, in which full circulation and cleaning out of the wellbore 20 during deployment of the downhole tool 100 is performed. Another example mode can be downhole motor activation mode, in which fluid movement to operate the hydraulic motor 113 is circulated to then operate the piston sub-assembly 106.

Alternatively, this mode of operation can occur to change the tool mode from regular circulation to tubing cutter activation, which is another example mode of operation. In tubing cutter activation, flow is circulated so that the hydraulic motor 113 can generate power to operate the cutting sub-assembly 104 to cut, for example, the production tubing 60 uphole of the stuck seal assembly 62 (in order to then pull the tubing and seal assembly 62 from the wellbore 20).

By applying certain pressure and rate with a wellbore fluid circulated to the multicycle valve tool 450, the downhole tool 100 can be alternately operated between the example modes of operation. For instance, once the downhole tool 100 reaches a particular depth adjacent the seal assembly 62, the tool 100 can be operated in a particular mode of operation depending on the flow rate and/or fluid pressure of a wellbore fluid 460 (for example, drilling mud, water, or other fluid) circulated to the multicycle valve tool 450. Changes in the flow rate and/or fluid pressure of the wellbore fluid 460 can adjust operation of the downhole tool 100 between modes, such as from regular circulation to motor activation mode, from regular circulation to tubing cutter activation mode, or any mode back to regular circulation to allow fluid passthrough of the downhole tool 100.

This example implementation of the downhole tool 100 also includes a bottom sub-assembly 114 that is coupled with the motor assembly 108. In some aspects, the bottom sub-assembly 114 comprises a downhole termination of the downhole tool 100. Alternatively, the bottom sub-assembly 114 can provide a location to couple or attach further sub-assemblies or tools to the downhole tool 100.

Figure 3:
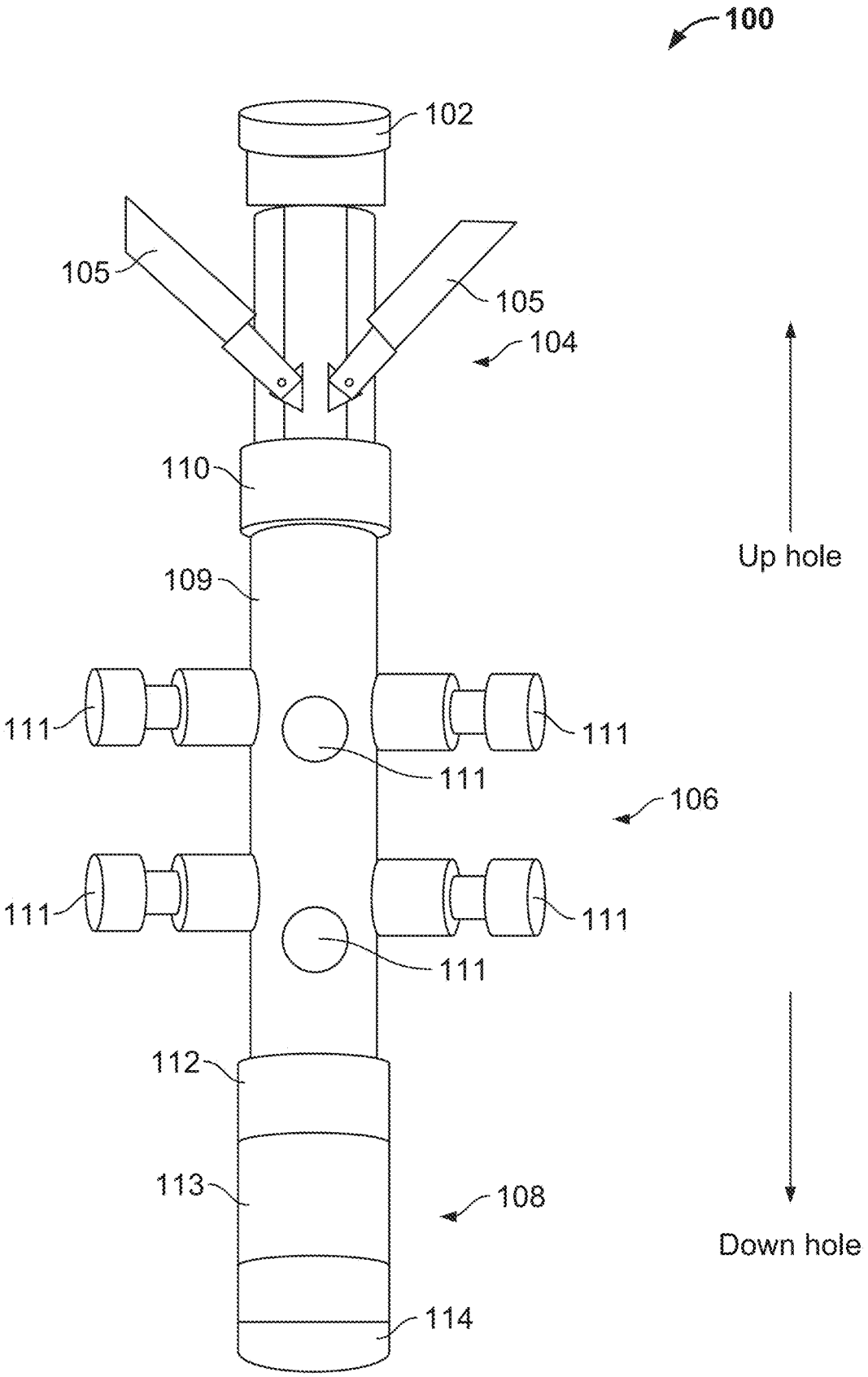

FIG. 3 is a schematic diagram of an example implementation of the downhole tool 100, such as in a tubing cutter activation mode. As shown in FIG. 3, the tubing cutter assembly 104 of downhole tool 100 has been activated so that blades 105 are extended from the tool 100 (and can rotate about the tool 100). In such an operation, the motor 113 can generate, for example, electrical power to operate the tubing cutter sub-assembly 104, whether through a power take-off (in the case of an electric motor 113 and power provided by wireline 50) or through electrical power generated by a hydraulic motor 113.

In tubing cutter activation mode, the tubing cutter assembly 104 can be deployed to cut through, for example, the production tubing 60 if the seal assembly 62 cannot be unstuck from the production packer 64 by operation of the piston sub-assembly 106. After cutting through the production tubing 60, for instance, a fishing tool can be run into the wellbore 20 to retrieve the seal assembly 62, the production packer 64, or both (in one or multiple trips).

Figure 4A:
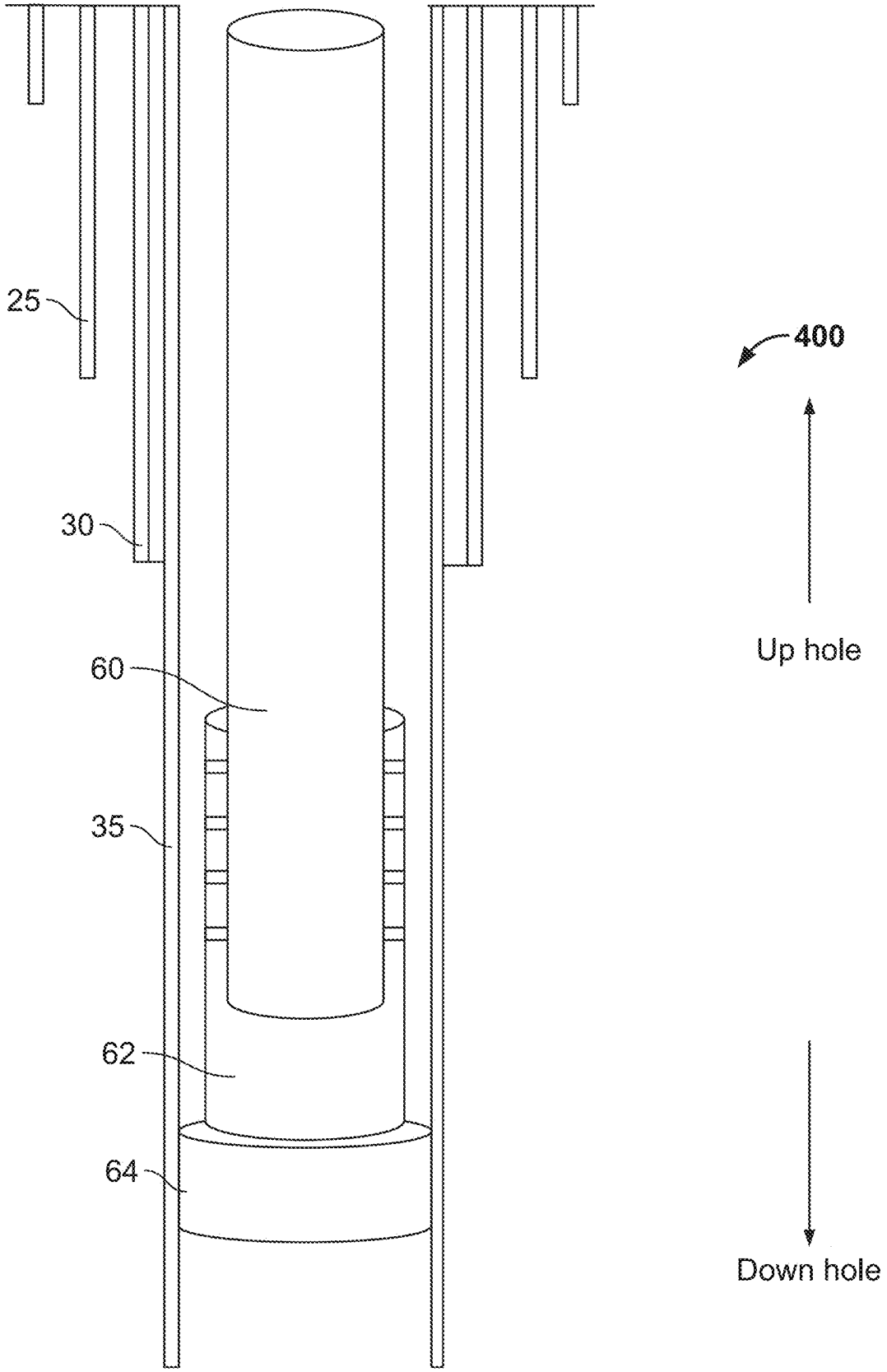
FIGS. 4A-4C are schematic diagrams of an example process for operating the downhole tool of FIGS. 2 and 3 to free a seal assembly that is stuck in a wellbore according to the present disclosure.
Figure 4B:
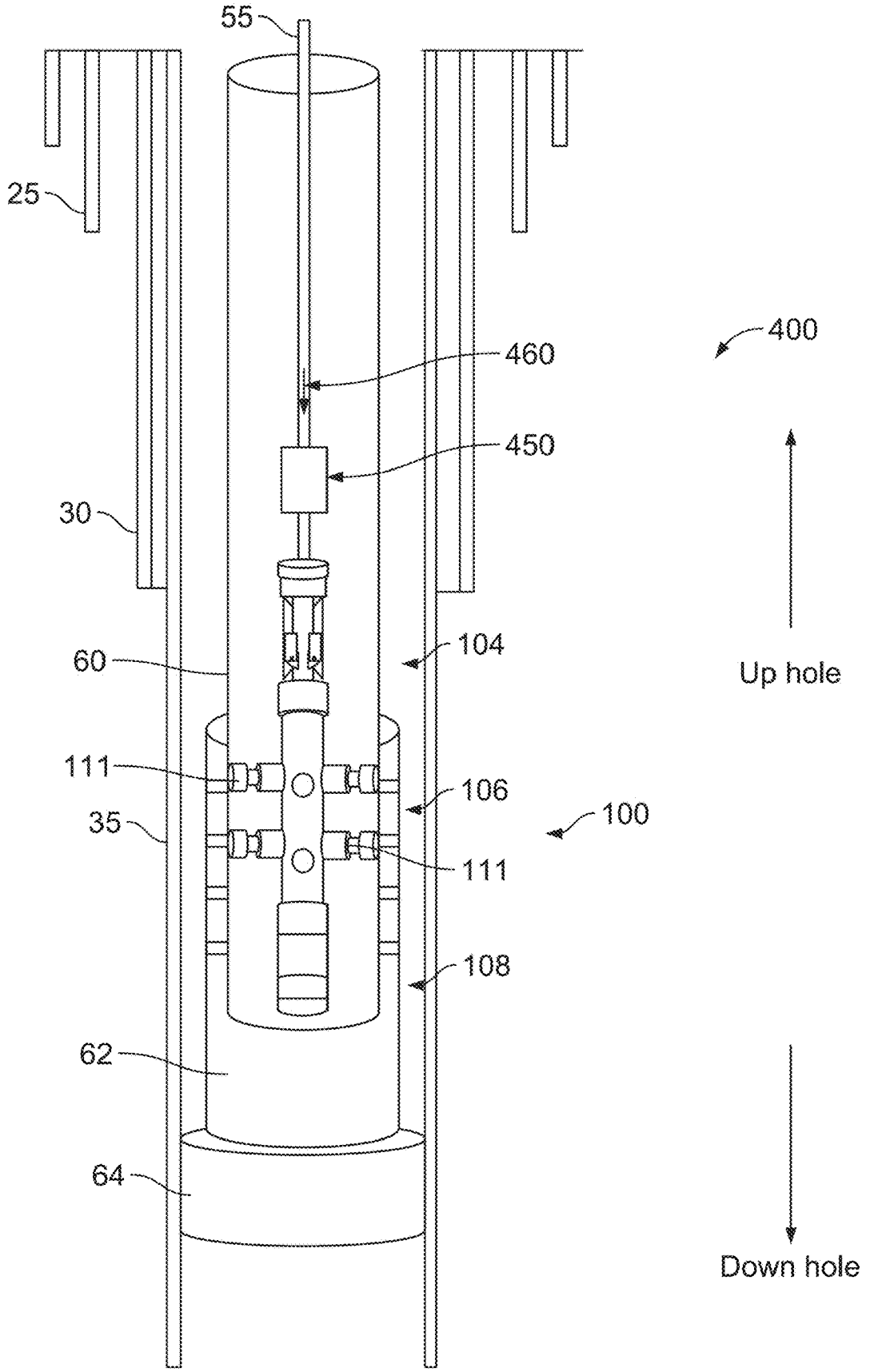
Figure 4C:
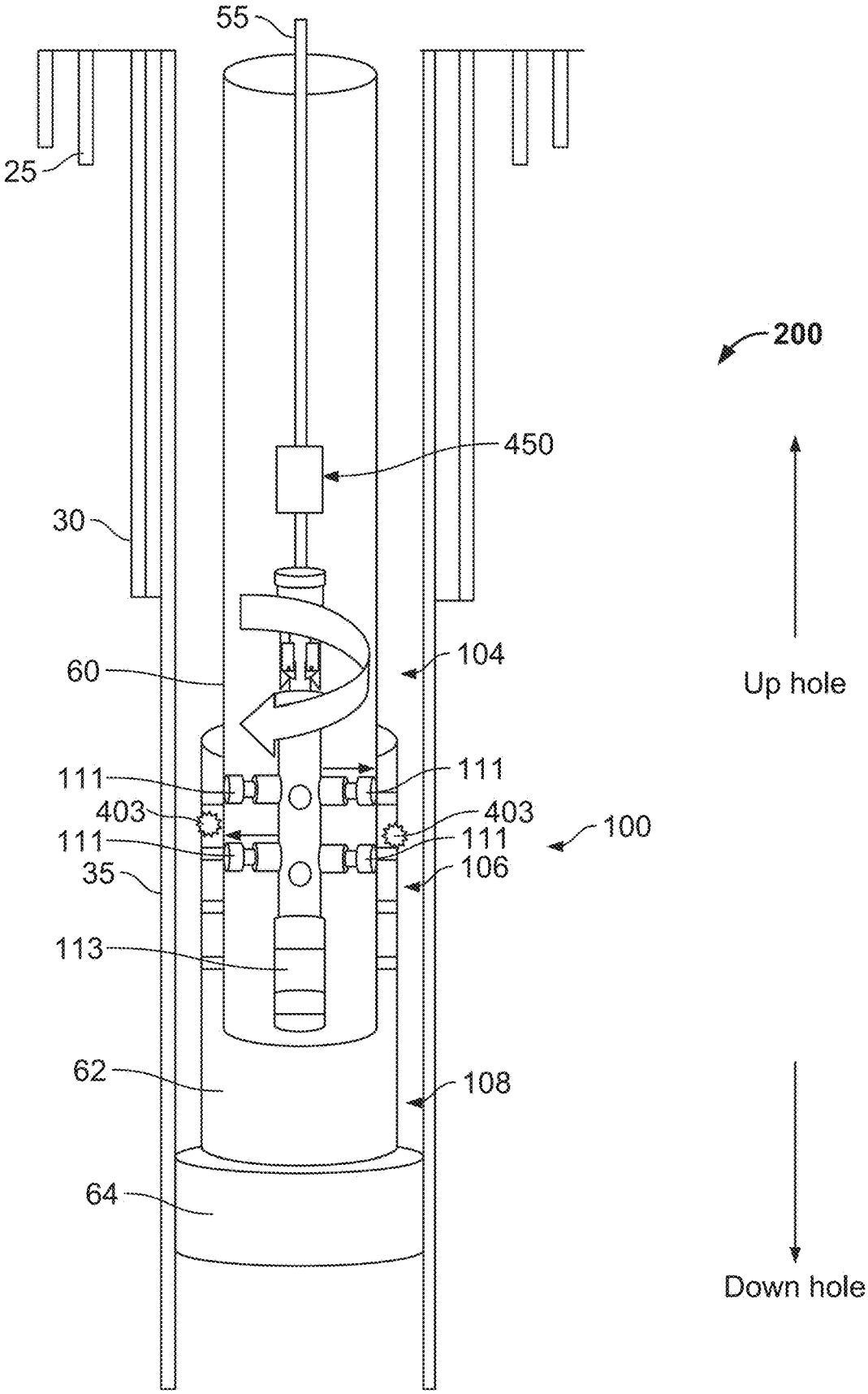

FIGS. 4A-4C are schematic diagrams of an example process for operating the downhole tool 100 of FIGS. 2 and 3 to free a seal assembly that is stuck in a wellbore according to the present disclosure. For example, turning to FIG. 4A, a stuck seal assembly 62 is shown installed into a production packer 64. Production tubing 60 is set or installed into the seal assembly 62. In this example, the seal assembly 62 becomes stuck in the production packer 64 or alternatively, the seal assembly 62-production packer 64 combination is stuck in the wellbore; in other words, stuck in the production tubing 60.

Turning to FIG. 4B, this figure illustrates the downhole tool 100 subsequent to being run into the production tubing 60 on downhole conveyance 50 to a location just uphole of the seal assembly 62. At this location and turning to FIG. 4C, the piston sub-assembly 106 can be activated (such as by the motor 113) to cause pistons 111 to hammer an internal radial surface of the seal assembly 62 to generate impacts 403 the seal assembly 62. In some aspects, the pistons 111 can hammer the internal radial surface at an angle perpendicular to the uphole/downhole axis or offset from perpendicular. In addition, in some aspects, a frequency of the motor 113 can be varied to also vary the contact frequency of the pistons 111 with the internal radial surface of the seal assembly 62. The piston sub-assembly 104 can also be rotated (shown by the arrow) (so as to rotate housing 109, for instance) in order to rotate the activated pistons 111 radially within the seal assembly 62. Through this hammering, the seal assembly 62 can be jarred free from the production packer 64 (or the combination of the seal assembly 62 and the production packer 64 can be jarred free from the production tubing 60). Once freed, the seal assembly 62 or the combination of the seal assembly 62-production packer 64 can be pulled from the wellbore 20.

Although not shown in FIGS. 4A-4C, the example process can also include activating the tubing cutter sub-assembly 104, such as in the case of an inability to free the stuck seal assembly 62 (or production packer 64). Once activated, the blades 105 of the tubing cutter assembly 104 can slice through the production tubing 60 just uphole of the seal assembly 62. This step of the example process can occur without running the downhole tool 100 out of the wellbore subsequent to operation of the piston sub-assembly 106 as described with reference to FIG. 4C. Once the downhole tool 100 cuts through the production tubing 60, the downhole tool 100 can be run out of the wellbore 20 or can perform another piston sub-assembly operation.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a top sub-assembly configured to couple to a downhole conveyance that is operable to run the downhole tool into a wellbore formed from a terranean surface into a subterranean formation;

a piston sub-assembly coupled with the top sub-assembly and comprising a plurality of pistons configured to moveably contact a portion of a seal assembly installed in the wellbore to generate mechanical vibrations to jar the seal assembly from being stuck in the wellbore;

a cutting sub-assembly coupled with the top sub-assembly and the piston sub-assembly and comprising at least one cutting blade configured to moveably cut through a portion of a production tubing adjacent the seal assembly; and a motor assembly coupled with the piston sub-assembly and the cutting sub-assembly, the motor assembly comprising a motor configured to:

supply power to the piston sub-assembly to move the plurality of pistons to contact the portion of the seal assembly installed in the wellbore to generate the mechanical vibrations to jar the seal assembly from being stuck in the wellbore; and supply electrical power to the cutting sub-assembly to rotate the at least one cutting blade to cut through the portion of the production tubing adjacent the seal assembly.

2. The downhole tool of claim 1, wherein the downhole conveyance comprises a wireline and the motor comprises an electric motor configured to operate with electrical power supplied through the wireline to operate the piston sub-assembly and provide electrical power to the cutting sub-assembly.

3. The downhole tool of claim 1, wherein the plurality of pistons are configured to moveably contact the portion of the seal assembly at an angle offset from an axial direction of the wellbore.

4. The downhole tool of claim 1, wherein the seal assembly is installed in a production packer, and the plurality of pistons are configured to moveably contact the portion of the seal assembly installed in the production packer to generate the mechanical vibrations to jar the seal assembly from being stuck in the production packer.

5. The downhole tool of claim 4, wherein the portion of the seal assembly comprises an interior radial surface of the seal assembly.

6. The downhole tool of claim 1, wherein the downhole conveyance comprises a tubular working string and the motor comprises a hydraulic motor configured to operate with a flow of a wellbore fluid supplied through the tubular working string to operate the piston sub-assembly and generate electrical power to the cutting sub-assembly.

7. The downhole tool of claim 6, wherein the tubular working string comprises a multicycle valve installed uphole of the top sub-assembly, the multicycle valve configured to operate the hydraulic motor in a plurality of operating modes based on one or more characteristics of the flow of the wellbore fluid.

8. The downhole tool of claim 7, wherein the one or more characteristics of the flow of the wellbore fluid comprises at least one of a flow rate or a pressure of the flow of the wellbore fluid.

9. The downhole tool of claim 7, wherein, in a first operating mode, the hydraulic motor is configured to operate the piston sub-assembly with the flow of the wellbore fluid.

10. The downhole tool of claim 9, wherein, in a second operating mode, the hydraulic motor is configured to generate electrical power to the cutting sub-assembly with the flow of the wellbore fluid.

11. A method for freeing a stuck seal assembly in a wellbore, comprising:

running a downhole tool on a downhole conveyance through the wellbore formed from a terranean surface into a subterranean formation, the downhole tool comprising:

a piston sub-assembly coupled with the top sub-assembly and comprising a plurality of pistons;

a cutting sub-assembly coupled with the top sub-assembly and the piston sub-assembly and comprising at least one cutting blade; and a motor assembly coupled with the piston sub-assembly and the cutting sub-assembly, the motor assembly comprising a motor;

operating the motor to supply power to the piston sub-assembly to move the plurality of pistons to contact a portion of a seal assembly installed in the wellbore to generate mechanical vibrations to jar the seal assembly from being stuck in the wellbore; and operating the motor to supply electrical power to the cutting sub-assembly to rotate the at least one cutting blade to cut through a portion of a production tubing adjacent the seal assembly.

12. The method of claim 11, wherein the downhole conveyance comprises a wireline and the motor comprises an electric motor, the method comprising:

operating the electric motor with electrical power supplied through the wireline to operate the piston sub-assembly; and providing electrical power from the electric motor to the cutting sub-assembly.

13. The method of claim 11, comprising operating the plurality of pistons to moveably contact the portion of the seal assembly at an angle offset from an axial direction of the wellbore.

14. The method of claim 11, wherein the seal assembly is installed in a production packer, the method comprising:

operating the plurality of pistons to moveably contact the portion of the seal assembly installed in the production packer to generate the mechanical vibrations to jar the seal assembly from being stuck in the production packer.

15. The method of claim 14, wherein the portion of the seal assembly comprises an interior radial surface of the seal assembly.

16. The method of claim 11, wherein the downhole conveyance comprises a tubular working string and the motor comprises a hydraulic motor, the method comprising:

operating the hydraulic motor with a flow of a wellbore fluid supplied through the tubular working string to operate the piston sub-assembly; and generating electrical power to the cutting sub-assembly with the hydraulic motor.

17. The method of claim 16, wherein the tubular working string comprises a multicycle valve installed uphole of the top sub-assembly, the method comprising:

circulating the wellbore fluid at one or more characteristics through the multicycle valve to operate the hydraulic motor in a plurality of operating modes.

18. The method of claim 17, wherein the one or more characteristics of the flow of the wellbore fluid comprises at least one of a flow rate or a pressure of the flow of the wellbore fluid.

19. The method of claim 17, comprising, in a first operating mode, operating the hydraulic motor to operate the piston sub-assembly with the flow of the wellbore fluid.

20. The method of claim 19, comprising, in a second operating mode, operating the hydraulic motor to generate electrical power to the cutting sub-assembly with the flow of the wellbore fluid.

21. A downhole tool, comprising:

a top sub-assembly configured to couple to a downhole conveyance that is operable to run the downhole tool into a wellbore formed from a terranean surface into a subterranean formation, the downhole conveyance comprising a tubular working string that comprises a multicycle valve installed uphole of the top sub-assembly;

a piston sub-assembly coupled with the top sub-assembly and comprising a plurality of pistons configured to moveably contact a portion of a seal assembly installed in the wellbore to generate mechanical vibrations to jar the seal assembly from being stuck in the wellbore;

a cutting sub-assembly coupled with the top sub-assembly and the piston sub-assembly and comprising at least one cutting blade configured to moveably cut through a portion of a production tubing adjacent the seal assembly; and a motor assembly coupled with the piston sub-assembly and the cutting sub-assembly, the motor assembly comprising a hydraulic motor configured to operate with a flow of a wellbore fluid supplied through the tubular working string to operate the piston sub-assembly and generate electrical power to the cutting sub-assembly supply, the multicycle valve configured to operate the hydraulic motor in a plurality of operating modes based on one or more characteristics of the flow of the wellbore fluid, wherein:

in a first operating mode, the hydraulic motor is configured to operate the piston sub-assembly with the flow of the wellbore fluid; and in a second operating mode, the hydraulic motor is configured to generate electrical power to the cutting sub-assembly with the flow of the wellbore fluid.

* * * * *